United States Patent [19]

Morrison

[11] 4,253,778

[45] Mar. 3, 1981

[54] WINCH APPARATUS FOR VIBRATING CONCRETE SCREED

[76] Inventor: Donald R. Morrison, 2109 Camp Green St., Charlotte, N.C. 28208

[21] Appl. No.: 29,654

[22] Filed: Apr. 13, 1979

[51] Int. Cl.[3] ..... E01C 19/38

[52] U.S. Cl. ..... 404/114; 404/118

[58] Field of Search ..... 404/118, 119, 114, 120, 404/106, 101, 96, 97, 102, 103; 425/456; 242/86.5 R

[56] References Cited

U.S. PATENT DOCUMENTS

| | | | |
|---|---|---|---|
| 1,390,479 | 9/1921 | Baker | 404/120 |
| 1,440,606 | 1/1923 | Johnston | 404/119 |
| 2,065,698 | 12/1936 | Heltzel | 404/101 |
| 2,094,910 | 10/1937 | Baily | 404/96 |
| 3,164,072 | 1/1965 | Blankenship | 404/96 |
| 3,318,208 | 5/1967 | Durston | 404/102 |
| 3,377,933 | 4/1968 | Dale | 404/119 X |
| 3,412,658 | 11/1968 | Griffin | 404/119 |
| 3,767,312 | 10/1973 | Raymond | 404/106 |
| 4,030,873 | 6/1977 | Morrison | 404/119 X |
| 4,132,492 | 1/1979 | Jenkins | 404/119 |

FOREIGN PATENT DOCUMENTS

| | | | |
|---|---|---|---|
| 510260 | 2/1955 | Canada | 404/119 |

*Primary Examiner*—Nile C. Byers, Jr.
*Attorney, Agent, or Firm*—B. B. Olive

[57] ABSTRACT

A vibrating concrete screed having a motor driven vibrating shaft in an elongated frame mounts at each end of a single or interconnected plural frames a detachable winching unit driven by the shaft through a fluid motor. The screed may be winched automatically, at varying angles, at different speeds at each end and with the winching units performing a screeding function.

1 Claim, 4 Drawing Figures

WINCH APPARATUS FOR VIBRATING CONCRETE SCREED

BACKGROUND OF THE INVENTION

1. Field of the Invention

This invention relates to lightweight, portable, vibrating concrete screeds and more specifically to screeds of this type having a winching mechanism.

2. Description of the Prior Art

A lightweight, portable, vibrating concrete screed of a type to which the present invention is applicable is fully described in applicant's prior U.S. Pat. No. 4,030,873. The general state of the art with respect to the type of screeds to which the present invention relates is believed to be fully set forth in such patent and therefore will not be repeated. Reference is also made to applicant's copending application, Ser. No. 883,955 filed Mar. 6, 1978 entitled "Portable Vibrating Concrete Screed" in which there is shown a winching means driven by a gasoline engine on the screed such that the screed may be winched automatically, at varying angles and at different speeds at each end of the screed. However, the winching mechanism referred to in such copending application does not provide a detachable winching unit driven by the shaft through a fluid motor and with all of the advantages of the winching unit of the present invention as later described.

Another type of self-propelled screed having a winch mechanism is manufactured by the Racine Construction Tool Company, 2200 South Broad Street, Racine, Wis. 53404. Unlike the detachable winching unit of the present invention, the winch mechanism of this reference does not utilize a vibrating screed shaft as the drive mechanism for the winching unit. Further, the winching mechanism described in this reference does not provide a detachable winching unit which can be mounted at each end of a screed frame or at each end of a plurality of interconnected screed frames.

Other types of winching mechanisms for screeds are found in U.S. Pat. Nos. 3,412,658 and 4,132,492.

With the foregoing prior art and all other prior art in mind of which applicant has knowledge, it seems evident that the prior art has not provided a lightweight, portable, vibrating concrete screed of the open frame and vibrating shaft type as described in U.S. Pat. No. 4,030,873 with a detachable winching mechanism that can be driven from the vibrating shaft and that can be quickly adapted to any length of screed made up of interconnected screeding units. From a practical viewpoint, the prior art has not provided such a detachable winching mechanism which itself is designed as a unitary screeding unit for imparting uniform vibrations throughout its length to complement the uniform vibrations imparted throughout the length of the screeding unit to which the screeding mechanism unit is attached.

SUMMARY OF THE INVENTION

In accordance with the present invention, a portable, lightweight, vibrating concrete screed such as described in U.S. Pat. No. 4,030,873 is provided with detachable winching units which may be attached to the ends of a base frame unit or to the ends of interconnected frame units.

The base frame unit mounts a drive engine which in turn drives a vibrating shaft in loose bearing arrangements as disclosed in U.S. Pat. No. 4,030,873. The winching mechanism units of the invention are provided with screed blades which mate with the screed blades of the base frame unit or with the screed blades of any sub-frame unit to which the winching mechanism unit of the invention is attached. A turnbuckle arrangement enables the winching mechanism unit to be easily and quickly adjusted with respect to the base frame unit or individual sub-frame unit to which the winching mechanism unit is attached. Thus, the winching mechanism units of the invention in combination with the base frame unit or the base frame unit interconnected with other individual sub-frame units may screed in various configurations, such as flat, crowned or with a valley and the invention winching mechanism units may be adjusted accordingly.

A fluid motor is provided on each winching mechanism unit with means for varying the speed of the motor which in turn enables the overall screed to be winched automatically by anchoring the ends of the winching cables to suitable deadman structure. Also, the winching mechanism units may be easily and quickly adjusted to cause the screed to operate at some fixed angle with respect to the concrete work or one end of the screed may operate at a different winching speed as compared to the winching speed of the other end of the screed. Suitable deadman anchors are employed to secure the ends of the winching cables so that once the winching units are properly adjusted, the screed may be automatically winched without attention of the operator.

DESCRIPTION OF THE PREFERRED EMBODIMENT

As previously mentioned, the general, elongated open frame construction of the present invention generally follows the construction previously disclosed in U.S. Pat. No. 4,030,873. Therefore, the teaching of that patent is deemed incorporated herein by reference and those details which are fully set forth in that patent and which are applicable to the present invention may be understood by making reference to the patent and are not repeated here to simplify the description.

Figure 1:
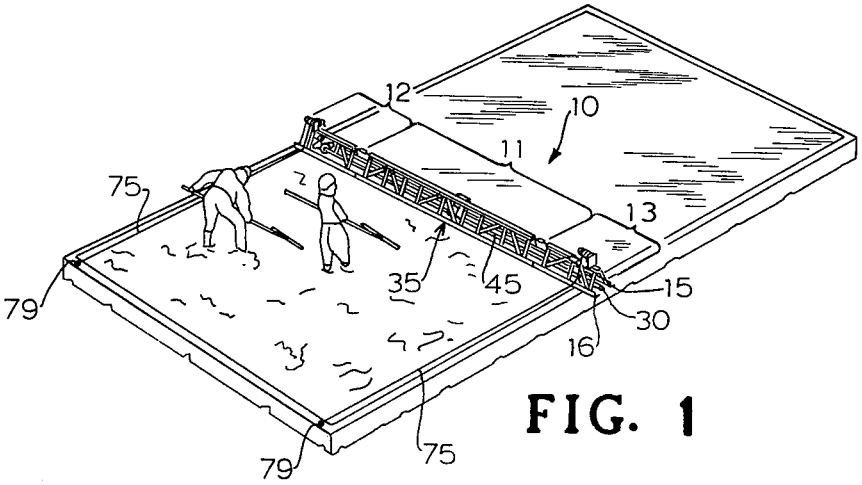
FIG. 1 is an isometric view of a vibrating concrete screed equipped with a pair of winching mechanism units at its ends according to the invention and being used in a typical concrete pouring and finishing operation.

As illustrated in FIG. 1, a screed 10 is illustrated as being formed of a base frame unit 11 constructed as previously described in U.S. Pat. No. 4,030,873 (hereinafter referred to simply as "the patent"), a detachable winching frame unit 12 and a detachable winching frame unit 13 according to the invention. The base frame unit 11 and winching frame units 12, 13 can be of various lengths and can be easily and quickly connected together, in a manner to be presently described, so at to provide different lengths of screeds for spanning forms of different widths. While it is to be understood that the individual frame units can vary in length, the base frame unit 11 is illustrated as being ten feet long and the winching frame units 12, 13 are each illustrated as being two and one-half feet in length. The individual frame units may be formed of any suitable material but are preferably formed of aluminum to reduce the weight.

Figure 4:
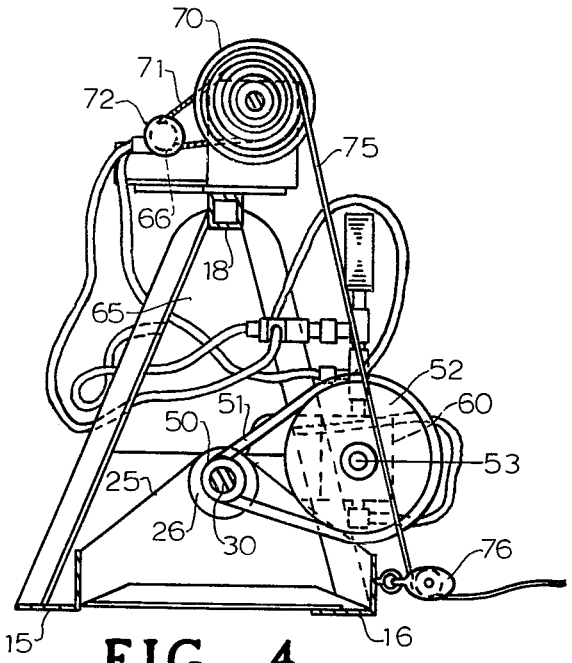
FIG. 4 is a section view taken generally along lines 4—4 of FIG. 3.
Figure 3:
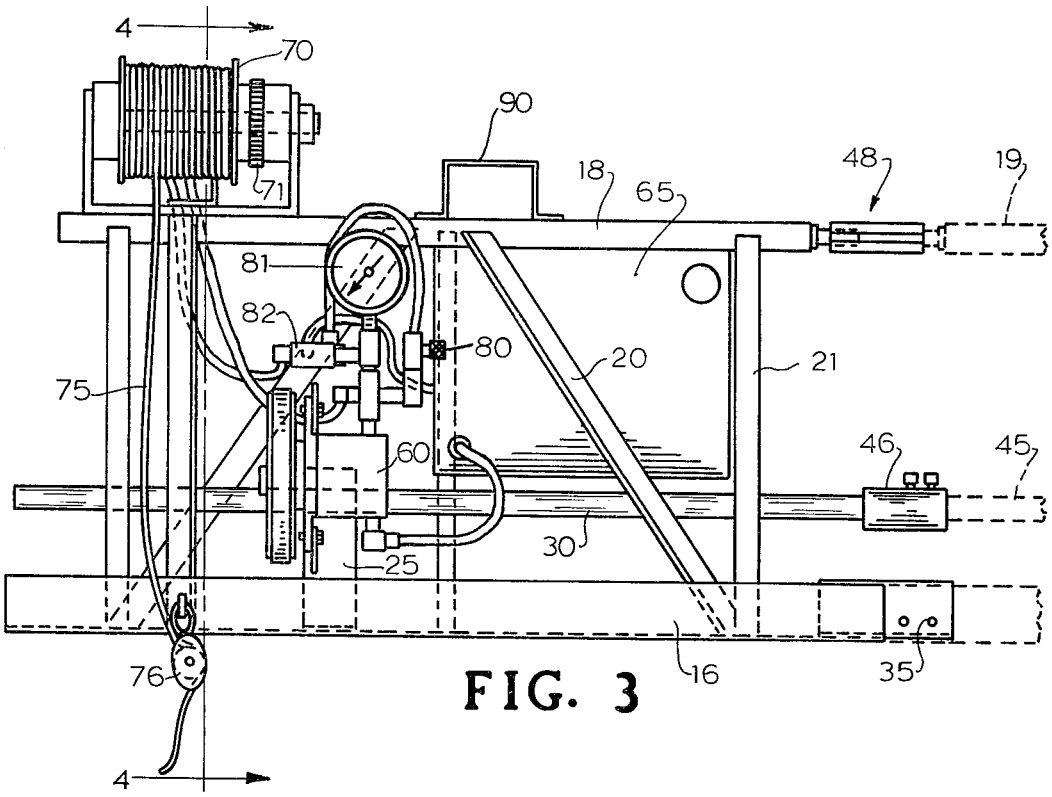
FIG. 3 is similar to FIG. 2 and looking at the side of the winching mechanism from the front.
Figure 2:
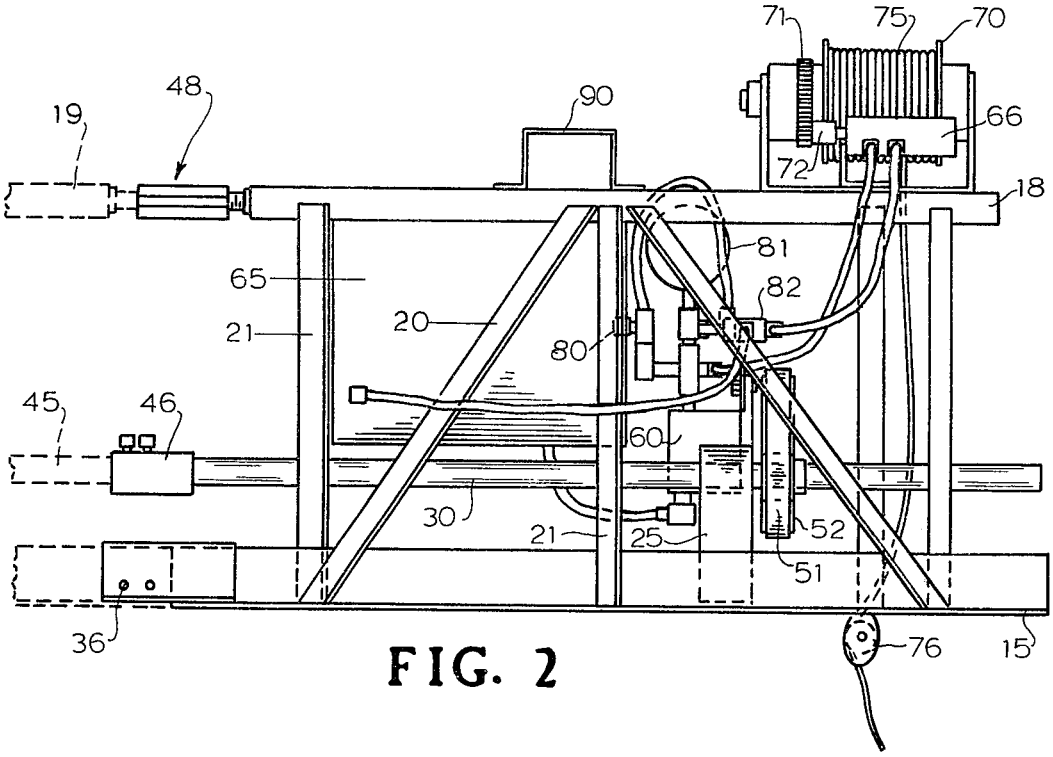
FIG. 2 is a side view looking towards the rear of an individual winching mechanism unit with a typical base frame unit or sub-frame unit being indicated in dashed lines.

Since the construction of the base frame unit 11 is fully described in the patent, the description will next turn to describing the construction of the left winching frame unit 12 as representing the construction used in both of the winching frame units 12, 13. Each winching frame unit comprises an elongate, open structure frame such as illustrated in FIGS. 2–4 including a pair of spaced apart screed plates 15, 16 which are illustrated as right angular members having vertical and horizontal legs each of which in the described example are one and three-quarter inches in width. The screed plates 15, 16 extend throughout the length of the winching frame unit and are adapted to engage and finish the concrete as the screed 10 is moved over the concrete in the direction of the arrow in FIG. 1. Thus, the screed plates 15, 16 on each of the winching frame units 12, 13 act as continuations of mating screed plates on the base unit 11.

Here it should be noted that according to the teaching of the patent, Pat. 4,030,873, the length of the base frame unit 11 was previously extended by attaching detachable screed frame units of the desired additional length. However, the extension frame units of the prior patent only performed a screed function and did not include the winching mechanism driven from the vibrating shaft as with the present invention. Thus, with the present invention, the winching frame units can serve both the screed function of the extension frame units of the prior patent and in addition provide detachable winching mechanisms for each end of the base frame unit 11.

While the open structure frame of the winching frame units of the invention may take various configurations in cross section, the cross section of the winching frame units 12, 13 should of course be compatible with the cross section of the base frame unit 11 and is illustrated and is preferably in the form of an isosceles triangle with the screed plates 15, 16 forming the lower corners of the triangle and with a ridge tube 18 forming the apex of the triangle.

The ridge tube 18 extends throughout the length of the winching frame unit and is connected to the screed plates 15, 16 by suitable cross and vertical braces. A bridging transverse bearing support 25 is fixed at opposite ends to the screed plates 15, 16 and mounts a bearing 26 which receives in a loose fitting arrangement the vibrating shaft 30 driven by the engine unit 35 which may be mounted and connected as fully described in the patent. Also as described in the patent, the semi-flexible shaft 45 also has a loose fit bearing arrangement in the base frame unit 11 so as to impart substantially uniform vibrations throughout the entire length of the base unit 11. The ends of the base frame unit 11 and the respective winching frame units 12, 13 are provided with means for quickly and easily connecting the left and right winching frame units on the ends of the base frame unit 11, or if base frame unit 11 has been previously extended in length to the ends of the extended base frame unit. This arrangement enables the respective screed plates, e.g. screed plates 15, 16, of the winching frame units to act as extensions of the screed plates of the base frame unit 11.

The coupling arrangement is similar to that previously described in the patent, i.e. U.S. Pat. No. 4,030,873, in that the ends of the screed plates 15, 16 which are to be joined to the screed plates on the base frame unit 11 are provided with angle extensions 35, 36 fixed at their inner ends to the respective screed plates 16, 17 with the outer ends thereof provided with enlarged bolt holes 39, 40 for receiving connecting bolts or the like so that the screed plates of the respective winching frame unit may be readily connected to the screed plates of the base frame unit 11. Also, the section of vibrating shaft 30 contained in the respective winching frame unit is connected to the drive shaft 45 of the base frame unit 11 which is driven by the engine 35 through a coupling 46. Another adjustable connecting sleeve 48 joins the ridge tube 18 of the respective winching frame unit to the ridge tube 19 of the base frame unit 11. Since the connection arrangement illustrated in FIG. 2 can be generally similar to the connection arrangement illustrated in the patent, i.e. U.S. Pat. No. 4,030,873, it is believed that the explanation given will suffice for those skilled in the art.

Referring more specifically to FIGS. 2, 3 and 4, it will be seen that the short length of drive shaft 30 contained in the winching frame unit 12 mounts a pulley 50 which through a belt 51 drives another pulley 52. Pulley 52 is mounted on a shaft 53 which is connected to drive an oil pump 60 to circulate fluid under pressure between a reservoir 65 and a fluid motor 66 which is arranged to drive a winching drum 70 through a belt 71 and drive pulley 72 driven by motor 66. Thus the winching cable 75 which is tracked through appropriate guide 76 and is secured to appropriate anchors such as deadman 78 and deadman 79 can be used to pull the screed as depicted in FIG. 1. An appropriate flow valve 80 allows the speed of fluid motor 66 to be adjusted and the piping system includes a fluid pressure gauge 81 and a preset pressure overload valve 82. Since the general operation of fluid motors in this type of arrangement is well understood in the art, it appears sufficient to note simply that when the segmental shaft 30 is driven by the main vibrating shaft 45 of the base frame unit 11 pump 60 will be caused to circulate fluid, e.g. oil, between the reservoir 65 and the fluid motor 66 so as to operate the cable drum 70 and reel the cable 75. During operation, it will also be understood that each of the winching frame units 12, 13 will have its own respective control valve 80 to control the speed of operation of the respective cable drum 70. Thus the overall screed 10, as depicted in FIG. 1, can be either operated in a somewhat perpendicular relation as shown in FIG. 1 or can be angled with one or the other ends leading, or some difference in speed of cable drum operation can be set between the two cable drums for the respective winching frame units 12, 13.

Of unique importance, it can be seen that each of the respective winching frame units 12, 13 provide respective pairs of screed plates, e.g. screed plates 15, 16, which operate as extensions of the screed plates of the base unit 11 or of any extension of the base unit 11. Thus, the winching frame units of the invention perform a screeding operation as well as provide a mechanism by which the entire screed can be drawn over the concrete at some predetermined rate and angle. Also, because of the loose bearing arrangement provided in the bearing mount 25, the short segmental drive shaft 30 tends to vibrate and impart substantially uniform vibrations for the length of the screed plates on the respective winching frame unit. Sufficient vibration of shaft 25 to achieve the desired screeding operation does not impair the drive operation required for driving the fluid pump 60. Thus, all of the objects of the invention are achieved. Because the same type of open lightweight frame construction as has been previously employed in the base frame unit 11 is carried over into the respective winching frame units 12, 13, the winching frame units are also lightweight and portable and can be handled by means of a conveniently located handle 90 when necessary for transport, storage, etc. Also, it will be understood that whenever the cable 75 is fully wound on the respective cable drums that it can be unwound as required by simply relieving the pressure in the piping system utilizing the respective valve controls 80 as required.

What is claimed is:

1. A self-propelled concrete screed comprising:

(a) a base screed unit including:

(i) an elongated open frame structure comprising at least one frame unit and if more than one a group of interconnected separable frame units of similar construction each mounting a plurality of screed plates for engaging and leveling concrete as the screed is moved over the concrete;

(ii) a vibrating element comprising a semi-flexible shaft rotatively supported in said frame structure and extending for the length thereof and having means operatively associated with said shaft enabling said shaft when driven to deflect between points of support and to impart substantially uniform vibrations throughout the lengths of each of said screed plates; and (iii) drive means mounted intermediate the ends of said base screed unit and connected to drive said shaft to impart said vibrations to said plates; and (b) a pair of auxiliary combined winching and screed units each comprising:

(i) an elongated open frame structure of less length than said base screed unit and adapted to mate the open frame structure of said base screed unit with an equal plurality of mating screed plates for engaging and leveling concrete for the length of the auxiliary unit as an extension of the length engaged and leveled by said base screed unit;

(ii) means for detachably connecting adjacent end portions of said base screed unit and auxiliary open frame structures in fixed relationship including when desired an angular relationship;

(iii) a vibrating element comprising a semi-flexible shaft detachably connected to said base screed unit shaft at the juncture of said base screed unit and auxiliary open frame structures and rotatively supported in said auxiliary frame structure and extending for the length thereof and adapted to operate as an extension of said base screed unit shaft and to deflect and impart substantially uniform vibrations throughout the lengths of said auxiliary unit screed plates when said base screed unit shaft is rotated by said drive means;

(iv) a recirculating fluid pump, motor, reservoir and associated piping system mounted on said auxiliary unit open frame structure with said pump being connected to be driven off said auxiliary unit shaft to drive said motor and including valve means in said piping to regulate the flow of the fluid to said motor to vary the speed thereof; and (v) winching means mounted on said auxiliary unit frame structure including;

(a) a cable drum connected to be driven by said fluid motor;

(b) a cable wound on said drum; and (c) cable guide means secured on said auxiliary unit frame structure enabling said cable to be withdrawn from said drum and anchored at some selected position ahead of the position of the screed preparatory to being wound on said drum by operation of said motor;

whereby when said drive means on said base screed unit operates and rotates said base screed unit shaft, said pair of auxiliary screed units mounted at the ends of said base screed unit are enabled to simultaneously level the concrete at both ends of said base screed unit and winch said base screed unit and pair of auxiliary screed units forward over the concrete being screeded at a speed and angle with respect to the work determined by the setting of said valve means and speed of said drive means.

* * * * *